US012435614B2

(12) United States Patent
Shi et al.

(10) Patent No.: US 12,435,614 B2
(45) Date of Patent: Oct. 7, 2025

(54) SYSTEMS AND METHODS FOR DETECTING HIGH FREQUENCY TORSIONAL OSCILLATION

(71) Applicant: Schlumberger Technology Corporation, Sugar Land, TX (US)

(72) Inventors: Jibin Shi, Pearland, TX (US); Antoine Marcel Benard, Sugar Land, TX (US); Ke Ken Li, Sugar Land, TX (US); Fei Song, Sugar Land, TX (US); Yong Chang, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 26 days.

(21) Appl. No.: 18/483,081

(22) Filed: Oct. 9, 2023

(65) Prior Publication Data

US 2025/0116183 A1 Apr. 10, 2025

(51) Int. Cl.
*E21B 44/04* (2006.01)
*E21B 47/024* (2006.01)

(52) U.S. Cl.
CPC ..... *E21B 44/04* (2013.01); *E21B 47/024* (2013.01); *E21B 2200/22* (2020.05)

(58) Field of Classification Search
CPC ..... E21B 44/04; E21B 47/024; E21B 2200/22
See application file for complete search history.

(56) References Cited

U.S. PATENT DOCUMENTS

| | | | | |
|---|---|---|---|---|
| 2015/0226049 | A1* | 8/2015 | Frangos | G01V 11/00 702/6 |
| 2015/0233231 | A1 | 8/2015 | Rodney | |
| 2016/0237802 | A1* | 8/2016 | Boone | E21B 44/00 |
| 2021/0040839 | A1 | 2/2021 | Tackmann | |
| 2021/0270120 | A1 | 9/2021 | Hohl | |
| 2023/0117396 | A1* | 4/2023 | Chanpura | G01H 1/003 175/50 |
| 2023/0175382 | A1 | 6/2023 | Chen | |
| 2023/0193740 | A1 | 6/2023 | Hohl | |
| 2023/0258074 | A1* | 8/2023 | Whitlow | E21B 44/00 175/40 |

* cited by examiner

*Primary Examiner* — Nicole Coy
*Assistant Examiner* — Nicholas D Wlodarski
(74) *Attorney, Agent, or Firm* — Jeffrey D. Frantz

(57) ABSTRACT

Systems and methods provide a bottom hole assembly for a wellbore that includes a drill bit and multiple drilling tools. The multiple drilling tools include multiple sensors configured to capture a multiple instances of a common measurement type at multiple locations along a drill string. The multiple drilling tools also include processing circuitry configured to compare the multiple instances of the common measurement type to determine a difference among the multiple instances. The processing circuitry is also configured to determine that the difference is greater than a threshold corresponding to an inference of high frequency torsional oscillation. Furthermore, the processing circuitry is further configured to send an indication of an occurrence of high frequency torsional oscillation in the bottom hole assembly.

16 Claims, 4 Drawing Sheets

SYSTEMS AND METHODS FOR DETECTING HIGH FREQUENCY TORSIONAL OSCILLATION

BACKGROUND

The present disclosure generally relates to downhole drilling systems and detecting High Frequency Torsional Oscillation (HFTO) using legacy drilling tools.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Drilling systems have evolved over time with more and more horsepower. Drilling systems have also added Rotary Steerable Systems (RSS) that enable continuous drilling using rotation from the surface. Other improvements like polycrystalline diamond compact (PDC) bits, mud motor improvements, and the like may increase overall efficiency of drilling operations. With this increased efficiency, the amount of energy injected into cut rock has also drastically increased, and a Bottom Hole Assembly (BHA) used in the drilling operation may now be subject to more destructive drilling conditions. For instance, a new drilling dysfunction has been discovered: High Frequency Torsional Oscillation (HFTO). HFTO is self-excitation occurring during a drilling operation that may cause damage to drilling tools used in the drilling operation. However, current/legacy drilling tools may be blind to HFTO because the bandwidth of the sensors and their front-end filters are designed to capture low frequency information and attenuate high frequency signals. Thus, the current/legacy drilling tools are unable to directly detect HFTO. One way to detect HFTO events may be to design new drilling tools with new sensors and acquisition systems designed to measure and retain high frequency information. However, the cost in time and money may be quite large to implement and deploy such sensors at scale meaning that deploying such updated sensors and systems may be impractical and/or leave many drilling operations blind to HFTO events until the new equipment may be procured.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a bottom hole assembly for a wellbore that includes a drill bit and multiple drilling tools. The multiple drilling tools include multiple sensors configured to capture a multiple instances of a common measurement type at multiple locations along a drill string. The multiple drilling tools also include processing circuitry configured to compare the multiple instances of the common measurement type to determine a difference among the multiple instances. The processing circuitry is also configured to determine that the difference is greater than a threshold corresponding to an inference of high frequency torsional oscillation. Furthermore, the processing circuitry is further configured to send an indication of an occurrence of high frequency torsional oscillation in the bottom hole assembly.

In addition, certain embodiments of the present disclosure include non-transitory, computer-readable media having stored thereon instructions, that when executed by one or more processors, are configured to cause the one or more processors to control a drilling operation of a drill string that includes multiple sensors to capture a measurement type at multiple locations along the drill string. The instructions, when executed, are further configured to cause the one or more processors to receive an indication that high frequency torsional oscillation has likely occurred based at least in part on the capture of the measurement type at the multiple locations. Furthermore, the instructions, when executed, are further configured to take an appropriate action in response to the indication that high frequency torsional oscillation has likely occurred.

Furthermore, certain embodiments of the present disclosure include capturing, using multiple sensors, multiple instances of a measurement type at multiple locations along a drill string in a wellbore. Processing circuitry compares the multiple instances of the measurement type to determine a variation between the multiple instances of the measurement type. The processing circuitry also determines that the variation is greater than a threshold corresponding to high frequency torsional oscillation. The processing circuitry further sends an indication that high frequency torsional oscillation has likely occurred based at least in part on the comparison of the multiple instances of the measurement type and the threshold. Furthermore, a processor receives the changing parameter of a drilling operation in the wellbore based at least in part on receiving the indication that high frequency torsional oscillation has likely occurred.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
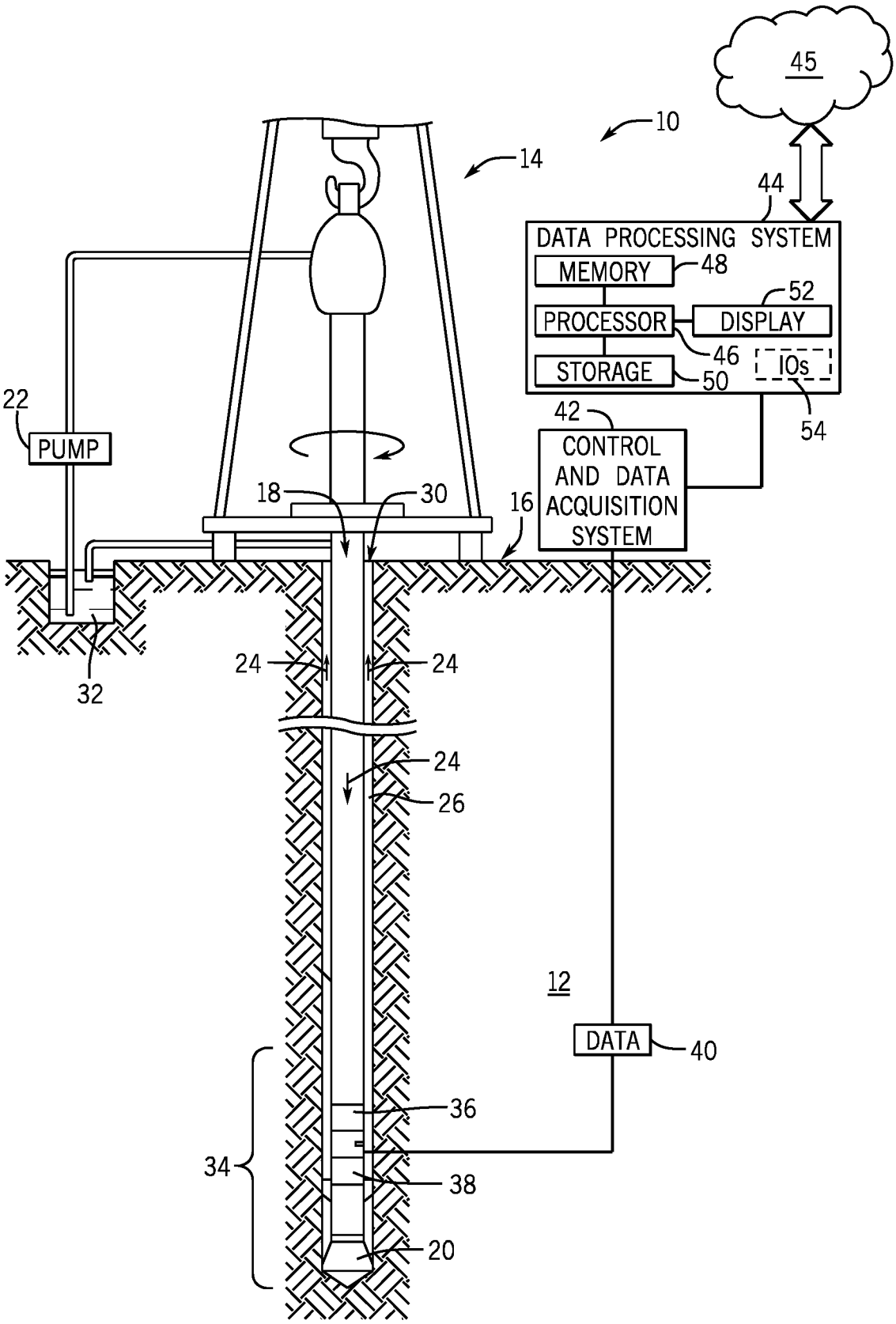
FIG. 1 illustrates a drilling system for drilling an earth formation using a piece of equipment that includes a bottom hole assembly, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skills having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements."

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "continuous", "continuously", or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment. In addition, as used herein, the terms "automatic", "automated", "autonomous", and so forth, are intended to describe operations that are caused to be performed, for example, by a computing system (i.e., solely by the computing system, without human intervention). Indeed, although certain operations described herein may not be explicitly described as being performed continuously and/or automatically in substantially real time during operation of the computing system and/or equipment controlled by the computing system, it will be appreciated that these operations may, in fact, be performed continuously and/or automatically in substantially real time during operation of the computing system and/or equipment controlled by the computing system to improve the functionality of the computing system (e.g., by not requiring human intervention, thereby facilitating faster operational decision-making, as well as improving the accuracy of the operational decision-making by, for example, eliminating the potential for human error), as described in greater detail herein.

Present embodiments relate to systems and techniques for indirectly detecting a likelihood of high frequency torsional oscillation (HFTO) in a bottom hole assembly of a drill string in a wellbore. For instance, a downhole logging while drilling tool may capture information about the drilling environment and/or the tools of the drill string. For instance, the downhole logging tool may capture information related to the orientation of tool faces of the bottom hole assembly, angular velocities of the tools of the bottom hole assembly, and/or other information. The instrumentation to capture these measurements may be configured to capture data at a relatively low frequency (e.g., 10 s-100 s of Hz) and may be unable to directly detect HFTO that is directly detectable at higher frequencies (e.g., >1 kHz). Since some of the measurements may each be measured by different sensors embedded in the drilling tools at different locations, even in the lower frequency data may be compared to determine whether there has been HFTO without changing the drilling tools to include higher frequency sensors/captures to directly determine HFTO. The multiple measurements of the same measurement type may be compared to indirectly determine HFTO by comparing a difference between the multiple measurements to a threshold that corresponds to a likelihood of HFTO occurring in the drill string. If the difference is greater than the threshold and has a corresponding duration signature (e.g., transient), HFTO may be deemed to have occurred. This threshold may be determined using emulation, field/laboratory testing, using a specialized BHA that measures the low frequency information along with a higher frequency sensor used to directly monitor HFTO to determine which differences in the low frequency information correspond to HFTO occurrence, or a combination thereof.

With the foregoing in mind, FIG. 1 illustrates a drilling system 10 used to detect high-frequency torsional oscillation (HFTO), as described in greater detail herein. The drilling system 10 may be used to drill a well into a geological formation 12 and obtain measurements useful to identify characteristics of the well and/or produce fluid from the well. In the drilling system 10 illustrated in FIG. 1, a drilling rig 14 at the surface 16 may rotate a drill string 18 having a drill bit 20 at its lower end. As the drill bit 20 is rotated, a drilling fluid pump 22 is used to pump drilling fluid 24, commonly referred to as "mud" or "drilling mud", downward through the center of the drill string 18 in the direction of the arrow to the drill bit 20. The drilling fluid 24, which is used to cool and lubricate the drill bit 20, exits the drill string 18 through the drill bit 20. The drilling fluid 24 then carries drill cuttings away from the bottom of a borehole 26 as it flows back to the surface 16, as illustrated by the arrows through an annulus 30 between the drill string 18 and the formation 12. However, as described above, as the drilling fluid 24 flows through the annulus 30 between the drill string 18 and the formation 12, the drilling fluid 24 may begin to invade and mix with the fluids stored in the formation 12, which may be referred to as formation fluid (e.g., natural gas or oil). At the surface 16, the return drilling fluid 24 may be filtered and conveyed back to a mud pit 32 for reuse.

As illustrated in FIG. 1, the lower end of the drill string 18 includes a bottom-hole assembly (BHA) 34 that may include the drill bit 20 along with various downhole tools as part of a drill string. The downhole tools may collect a variety of information relating to the geological formation 12 and/or the state of drilling of the well. For example, a measurement-while-drilling (MWD) module/tool 36 may measure certain drilling parameters, such as the temperature, pressure, orientation of one or more drilling tools, angular velocity of the one or more drilling tools, and so forth. Likewise, a logging-while-drilling (LWD) module 38 may measure the physical properties of the geological formation 12, such as density, porosity, resistivity, lithology, and so forth.

The LWD module 38 may collect a variety of data 40 that may be stored and processed within the LWD module 38 and/or may be sent (e.g., unprocessed, partially processed, or fully processed) to the surface 16 for processing.

The data 40 may be sent via a control and data acquisition system 42 to a data processing system 44. In some embodiments, the data processing system 44 is communicatively connected to a cloud network 45. The control and data acquisition system 42 may receive the data 40 in any suitable way. In certain embodiments, the control and data acquisition system 42 may transfer the data 40 via electrical signals pulsed through the geological formation 12 or via mud pulse telemetry using the drilling fluid 24. In other embodiments, the data 40 may be retrieved directly from the LWD module 38 when the LWD module 38 returns to the surface.

In certain embodiments, the data processing system 44 may include a processor 46, memory 48, storage 50, and/or a display 52. In some embodiments, the cloud network 45 may include one or more similar components, such as the processor 46, the memory 48, the storage 50, and/or the display 52. The data processing system 44 may use the data 40 to determine various properties of the formation 12 using any suitable techniques. As will be described in greater detail herein, the LWD module 38 may use certain selected materials to reduce signal contamination by stray neutrons. Thus, when the data processing system 44 processes the data 40, the determined formation properties may be more accurate and/or precise than otherwise determined.

It should be noted that FIG. 1 shows merely one example of a particular implementation of the data processing system 44 and is intended to illustrate the types of components that may be present in the data processing system 44. The processor 46 may include one or more processors that are operably coupled to the memory 48 and/or the storage 50. To process the data 40, the processor 46 may execute instructions stored in the memory 48, storage 50, and/or any other suitable article of manufacture that includes one or more tangible, non-transitory, and computer-readable media that at least collectively store the instructions or routines in at least one location. As such, the memory 48 and/or the storage 50 of the data processing system 44 may be any suitable article of manufacture that can store the instructions to enable the data processing system 44 to provide various functionalities. The memory 48 and/or the storage 50 may be ROM memory, random-access memory (RAM), flash memory, an optical storage medium, or a hard disk drive, to name a few examples. The display 52 may be any suitable electronic display that can display logs and/or other information relating to properties of the formation 12 as measured by the LWD module 38. It should be appreciated that, although the data processing system 44 is illustrated as being located at the surface, the data processing system 44 may be located in the LWD module 38. In such embodiments, some of the data 40 may be processed in the LWD module 38 and the data 40 may be stored in the LWD module 38, while some of the data 40 may be sent to the surface 16 in real time. This may be the case particularly in LWD, where a limited amount of the data 40 may be transmitted to the surface during drilling or reaming operations.

In some embodiments, the data processing system 44 may include one or more input/output devices (IOs) 54. The input/output devices 54 of the data processing system 44 may enable a user to interact with the data processing system 44 (e.g., pressing a button to increase or decrease a volume level). The input/output devices 54 may include one or more interfaces that may enable the data processing system 44 to interface with various other electronic devices (e.g., in the cloud 45). The interfaces may include, for example, one or more network interfaces for a personal area network (PAN), such as a Bluetooth network, for a local area network (LAN) or wireless local area network (WLAN), such as an IEEE 802.11x Wi-Fi network or an IEEE 802.15.4 wireless network, and/or for a wide area network (WAN), such as a cellular network. The interfaces may additionally or alternatively include one or more interfaces for, for example, broadband fixed wireless access networks (WiMAX), mobile broadband Wireless networks (mobile WiMAX), and so forth.

In certain embodiments, to enable the data processing system 44 to communicate over the aforementioned wireless networks (e.g., Wi-Fi, WiMAX, mobile WiMAX, 4G, LTE, and so forth), the data processing system 44 may include a transceiver. The transceiver may include any circuitry that may be useful in both wired or wirelessly receiving and wired or wirelessly transmitting signals (e.g., data signals). The transceiver may include a transmitter, a receiver, or a transmitter and a receiver combined into a single unit.

The input/output devices 54, in combination with the display 52, may allow a user to control the data processing system 44 and/or the drilling operation. For example, the input/output devices 54 may be used to control one or more parameters of the drilling device. Some input/output devices 54 may include a keyboard and/or mouse, a microphone that may obtain a user's voice for various voice-related features, and/or a speaker that may enable audio playback. The input/output devices 54 may also include an audio output that may provide a connection to external speakers and/or headphones.

Figure 2:
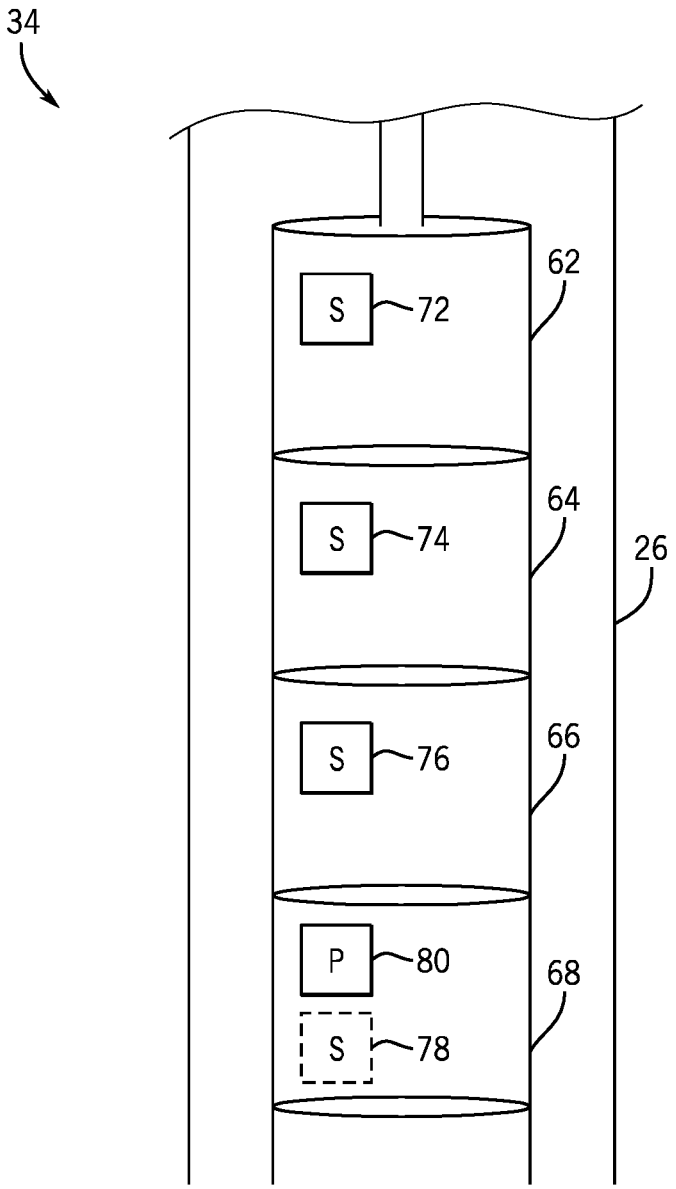
FIG. 2 illustrates a block diagram of a portion of the bottom hole assembly of FIG. 1 that includes at least two sensors to capture the same measurement type at different locations in the bottom hole assembly of FIG. 1, in accordance with embodiments of the present disclosure.

FIG. 2 is a block diagram of an embodiment of a portion of the BHA 34 that includes LWD modules 62, 64, 66, and 68 as part of a drill string in the borehole 26. In some embodiments, rotary-steerable systems (RSS) may be used in place of or in addition to LWD modules. The LWD module 62 includes a sensor 72 captures information during drilling in the borehole 26. The information captured during drilling may be the overall function or goal of what is monitored using the LWD module 62 or the information captured by the sensor 72 may only be a portion of (as embedded measurements) or related to the overall function or goal of what is monitored using the LWD module 62. For example, the sensor 72 may be used to measure angular velocity of the sensor 72, the LWD module 62, and/or any other portion of the drill string (e.g., collar rotations per minute), to detect a tool face orientation (e.g., such as an azimuthal position sensor), a stick-slip sensor, and/or other information that may relate to movement of at least a portion of the BHA 34. As used herein, stick-slip sensors are statistics gathering components (e.g., one or more sensors) that determine whether a stick-slip, a dynamic cyclic process where mating surfaces oscillate between a stick phase and a slip phase that causes a jerking motion, is occurring or has occurred.

The LWD module 64 includes a sensor 74 captures information during drilling in the borehole 26. The information captured during drilling may be the overall function or goal of what is monitored using the LWD module 64 or the information captured by the sensor 74 may be a portion of or related to the overall function or goal of what is monitored using the LWD module 64. For example, the sensor 74 may be used to measure angular velocity of the sensor 74, the LWD module 64, and/or any portion of the drill string, to detect a tool face orientation, a stick-slip sensor, and/or other information that may relate to movement of at least a portion of the BHA 34.

The LWD module 66 includes a sensor 76 captures information during drilling in the borehole 26. The information captured during drilling may be the overall function or goal of what is monitored using the LWD module 66 or the information captured by the sensor 76 may be a portion of or related to the overall function or goal of what is monitored using the LWD module 66. For example, the sensor 76 may be used to measure angular velocity of the sensor 76, the LWD module 66, and/or any other portion of the drill string, to detect a tool face orientation, a stick-slip sensor, and/or other information that may relate to movement of at least a portion of the BHA 34.

The LWD modules 62, 64, and/or 66 may be tools that perform the same overall function or goal for redundancy or perform different functions or goals. For example, at least two of the LWD modules 62, 64, and 66 may at least partially overlap in detecting depth, tension-compression-torque, or the like. Regardless, at least two of the LWD modules 62, 64, and 66 may capture the same or similar types of information in their respective sensors 72, 74, and 76, such as angular velocity information, tool face orientation information, stick-slip information, or any other information that may be related to movement of at least a portion of the BHA 34. This same or similar types of information may be compared and/or processed in the BHA 34. For example, a LWD module 68 or tool may include processing circuitry 80 that may have access to the same or similar types of information from the sensors 72, 74, and/or 76. The processing circuitry 80 may include any of the components in the data processing system 44. For instance, the processing circuitry 80 may include instances of the processor 46, the memory 48, and/or the storage 50. However, the processor 46, the memory 48, and/or the storage 50 in the processing circuitry 80 may be different (e.g., lower power, more electromagnetic pulse (EMP) resilient, smaller capacity, etc.) than the processor 46, the memory 48, and/or the storage 50 of the data processing system 44. As discussed below in more detail, the processor 46 of the LWD module 68 may compare the received information from the sensors 72, 74, and/or 76 to determine if the variance between the different measurements exceeds a threshold that may be indicative of HFTO. In other words, even though the instrumentation in the BHA 34 may be configured to measure lower frequency information than may be capable of detecting HFTO directly, by comparing multiple different measurements of the same and/or similar measurement types, HFTO may be indirectly detected by detecting a variation larger than a threshold that is set at a level to indicate that HFTO is present in the BHA 34.

In some embodiments, the LWD module 68 may perform more than dedicated processing. For instance, the LWD module 68 may include a sensor 78 that captures information during drilling in the borehole 26. For example, the sensor 78 may be used to measure angular velocity of the sensor 78, the LWD module 68, and/or any other portion of the drill string, to detect a tool face orientation, a stick-slip sensor, and/or other information that may relate to movement of at least a portion of the BHA 34.

Although the illustrated portion of the BHA 34 includes four distinct LWD modules 62, 64, 66, and 68, any other suitable number of LWD modules 62, 64, 66, and 68 may be included, as long as multiple of the same or similar measurement types are captured along the BHA 34. For example, two, three, or more LWD modules may be deployed with two, three, or more sensors to capture the same/similar measurements. Additionally or alternatively, in some embodiments, a LWD module may include multiple similar/same sensors that may be deployed in the drill string to capture the same/similar information at different locations in the BHA 34.

Figure 3:
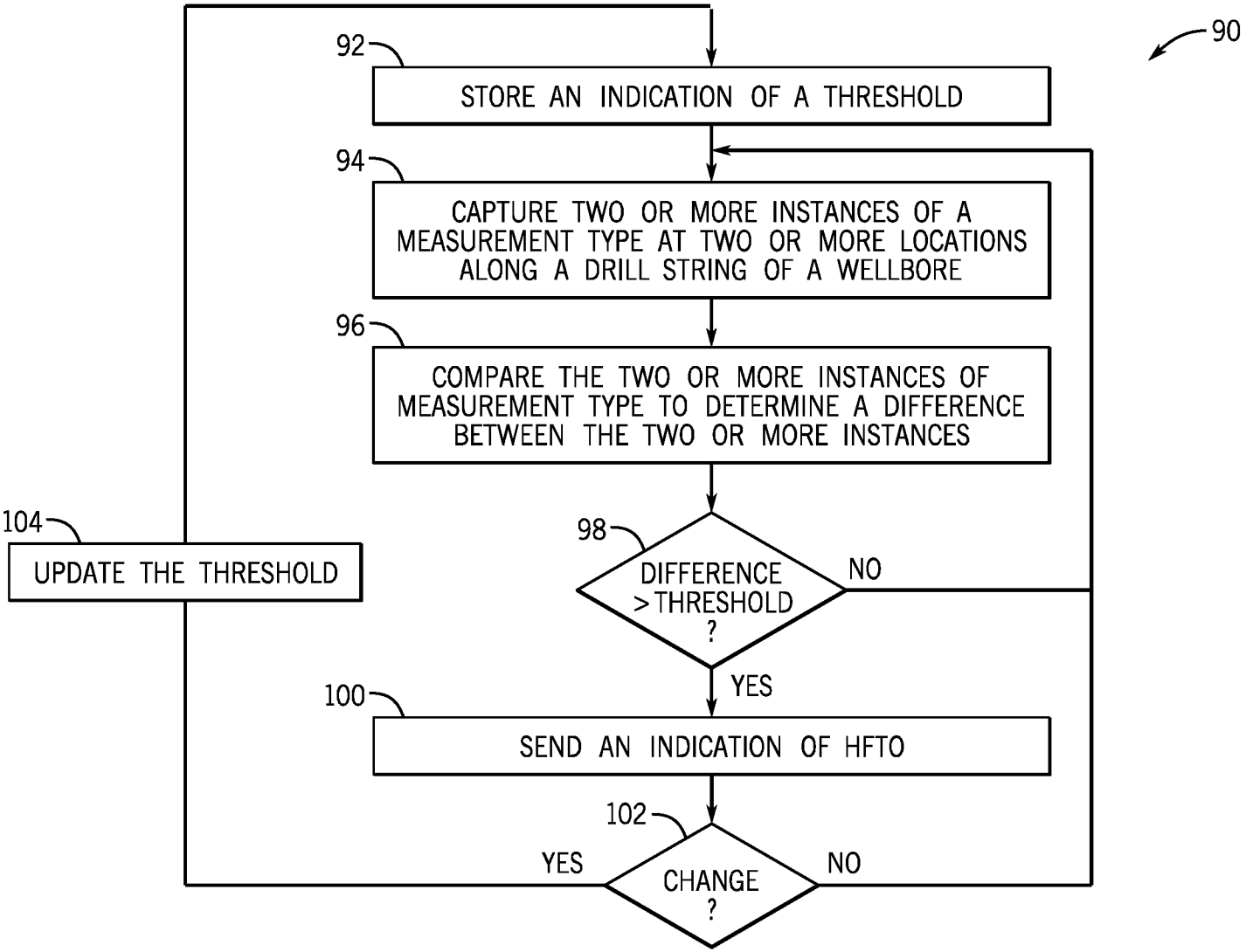
FIG. 3 illustrates a flow diagram of a process for detecting high frequency torsional oscillation (HFTO) indirectly using the at least two sensors of FIG. 2, in accordance with embodiments of the present disclosure.

FIG. 3 is a block diagram of a process 90 that may be used to determine whether there is HFTO in the drill string. The BHA 34 (e.g., the processing circuitry 80 of the LWD module 68), another portion of the drill string, and/or any other location in or near the borehole 26 may store a threshold (block 92). The threshold may be stored in memory and/or storage of the processing circuitry 80, of the data processing system 44, of the cloud 45, and/or any other suitable location. As previously noted, the threshold may be related to a parameter (e.g., angular velocity, tool face orientation, etc.) measured at multiple locations along the drill string/BHA 34. The value for the threshold may be determined using simulations that estimate that HFTO may occur during particular drilling operations through particular materials. Additionally or alternatively, the data may be captured using empirical data. For instance, in other boreholes 26, the parameter may be tracked at multiple locations where HFTO is known or suspected to have occurred. For example, the downhole tools may be examined after removal from the wellbores. Additionally or alternatively, prototype downhole tools may include the legacy measurements that measure the parameter at a lower frequencies while also measuring HFTO directly using one or more sensors that detect information at higher frequencies. For example, the lower frequencies may be 10s to 100*s* of Hz. The higher frequencies are greater than 1 kHz. Additionally or alternatively, the higher frequencies may be greater than at least one order of magnitude higher than the lower frequencies. The differences between the legacy measurements may be mapped to measured HFTO to determine the threshold above which HFTO may be deemed to have occurred.

This threshold value may change over time as the parts age. Thus, the threshold may be based at least in part on how long it has been since a device was manufactured, how long the tools have been deployed in a particular continuous drilling operation, how long the tools have been actively used in drilling in total, and/or any other age indications that may have been determined to impact the threshold using simulations using devices of different ages, empirical data of devices of different ages, testing devices of different ages, or a combination thereof. Furthermore, an age of multiple drilling tools may be designated by the oldest age (e.g., earliest manufacturing date, longest drilling deployment) of the drilling tools, the youngest age of the drilling tools, an average age of the drilling tools, a date since assembly of the bottom hole assembly (BHA) 34, or a combination thereof. Moreover, an average of the ages of the drilling tools may be applied using an unweighted average. Alternatively, since some devices may impact the overall health of the BHA 34 more heavily, the age of the BHA 34 may be a weighted average of the ages of the different drilling tools where the weight is the amount of impact on the overall "age" of the BHA 34. In some embodiments, the threshold value may vary based at least in part on formation type, wellbore tragedy, and operational conditions even with the same BHA 34 or similar BHAs 34 with the same age. For instance, for the BHA, simulations may be performed to theoretically determine the threshold values for different formation types, wellbore trajectories, and/or operational conditions. These values can be refined with accumulated field test data as the tools age. In some embodiments, such refinement may at least partially use machine learning and/or neural networking or other refinement techniques.

Returning to FIG. 3, two or more sensors of the BHA 34 capture two or more instances of a measurement type at two or more locations along a drill string of the wellbore 26 (block 94). For instance, any combination of the sensors 72, 74, 76, and 78 may be used to measure a same parameter (e.g., angular velocity, tool face orientation, etc.). As previously noted, these measurements may be made using tools (e.g., legacy tools) that capture their respective parameters at a rate too slow to directly determine whether HFTO has occurred. For instance, the frequency needed to determine HFTO directly may be at least one order of magnitude greater than the frequency of the sensors. In some embodiments, the frequencies of all of the sensors used to capture the two or more instances of a measurement type (e.g., sensors 72, 74, 76, and/or 78) may all use a same frequency to capture the parameter. Alternatively, at least two of the sensors used to capture the parameter may have different frequencies, but their instantaneous measurements may be close enough together in time to estimate HFTO.

The two or more instances of the measurement type are compared to determine a difference (or variance) between the two or more instances of the measurement type (block 96). The difference may be a greatest overall change among the two or more instances, a greatest change between measured values at adjacent locations, or a statistical computation (e.g., variance, mean, etc.). Furthermore, since HFTO may be inherently transient, the difference may have a duration factor where differences that do not have a corresponding duration (e.g., longer than a difference threshold) may be discarded as not related to HFTO. For instance, the comparison may be made using dedicated hardware and/or software. For example, a processor may be used to compare the two or more instances of the measurement type. In some embodiments, the communication rate between the BHA 34 and the data processing system 44 may be lower than a rate at which HFTO is to be monitored. For instance, the BHA 34 may only communicate with the data processing system 44 at a rate of once per minute. In such situations, the comparison may be performed using a processor and/or hardware in the BHA 34. However, in situations where the communication rate may be sufficient for such HFTO monitoring, such processing/comparisons may be performed in the data processing system 44.

If the difference (or variance) between the two or more instances of the measurement type (block 98) is not greater than the threshold, the BHA 34 may continue operation and continue capturing additional instances of the measurement type at two more locations. However, if the difference is greater than the threshold, the processor sends an indication that HFTO has occurred/is occurring in the wellbore 26 (block 100). For instance, the indication may be displayed as an alert on the display 52 and/or may be an electrical signal/data packet/flag that the processor sends/stores to cause a control change in the drilling operation.

As previously noted, the threshold may be fine tuned using accumulated field test results, based on changing conditions (e.g., formation types, wellbore trajectories, age of the tool(s), and/or operational conditions), and/or other updates, such as refinement of the old threshold to a new value using machine learning. Thus, a processor, such as the processor 46 and/or processor in the cloud 45, may determine whether the threshold is to change (block 102). For instance, if there is new data (field test results), based on changing conditions, and/or other updates. The processor and/or other circuitry (e.g., programmable logic device implementing a neural network), updates the threshold (block 104).

Figure 4:
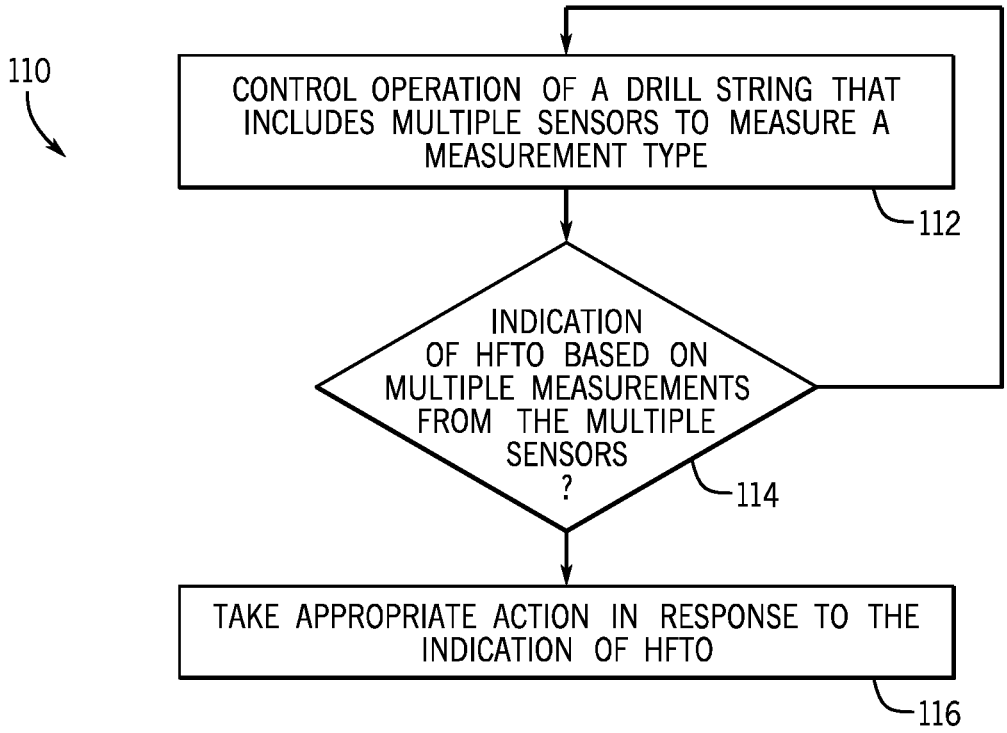
FIG. 4 illustrates a flow diagram of a process for performing operations in response to the detection of HFTO in FIG. 3, in accordance with embodiments of the present disclosure.

FIG. 4 is a block diagram of a process 110 that may be used in the data processing system 44 when the processing circuitry 80 performs the process 90 of FIG. 3. As illustrated, the processor 46 of the data processing system 44 controls operation of a drill string that includes multiple sensors to measure a common measurement type (block 112). For instance, controlling the operation may include managing/controlling a speed or RPM of rotation of the drill string, controlling/managing a weight on bit for the drilling operation, managing other speeds (pump speeds, mud flow rates, etc.), and/or managing other parameters involved in the drilling operation. The processor 46 tracks whether an indication of HFTO based on multiple measurements from multiple sensors at multiple locations along the drill string has been received (block 114). The indication may include a flag, data packet, and/or other electrical signal received from the BHA 34 (e.g., the processing circuitry 80) that indicates that a variance and/or difference between two or more instances of a measurement type (e.g., tool face orientation/tool position, angular velocity, etc.) exceeds a corresponding threshold. If an indication of the difference being greater than the threshold has not been received, the processor continues operating the drilling operation as it has been operating. However, if the processor 46 determines an indication has been received that the difference between the two or more instances of the measurement type is greater than the threshold, the processor 46 takes appropriate action in response to the indication of HFTO occurrence (block 116). For instance, the appropriate action may include the processor 46 flagging the HFTO occurrence in the drill string by causing an alert to be raised to the cloud 45 and/or the display 52. Additionally or alternatively, the processor 46 may make a change to one or more parameters in the drilling operation. For example, the processor 46 may cause a change in RPM in the drilling operation. Additionally or alternatively, the processor 46 may cause a weight on bit to change in the drilling operation. Additionally or alternatively, the processor 46 may cause mud flow to change and/or change auto driller parameters. Moreover, any other suitable change may be made in the operation in response to the indirect measurement of HFTO as indicated by the difference between the measured parameters being greater than the threshold.

The subject matter described in detail above may be defined by one or more clauses, as set forth below.

A bottom hole assembly for a wellbore includes a drill bit and a plurality of drilling tools. The plurality of drilling tools include a plurality of sensors configured to capture a plurality of instances of a common measurement type at a plurality of locations along a drill string. The bottom hole assembly also includes processing circuitry configured to compare the plurality of instances of the common measurement type to determine a difference among the plurality of instances. Furthermore, the processing circuitry is configured to determine that the difference is greater than a threshold corresponding to an inference of high frequency torsional oscillation and to send an indication of an occurrence of high frequency torsional oscillation in the bottom hole assembly.

The bottom hole assembly of any preceding clause, wherein the plurality of drilling tools include logging while drilling tools or rotary-steerable systems comprising the plurality of sensors.

The bottom hole assembly of any preceding clause, wherein the common measurement type includes a tool face orientation for the plurality of drilling tools.

The bottom hole assembly of any preceding clause, wherein the common measurement type includes angular velocities at the plurality of locations.

The bottom hole assembly of any preceding clause, wherein the threshold is based at least in part on simulations of drilling operations in various drilling environments.

The bottom hole assembly of any preceding clause, wherein the threshold is based at least in part on empirical data from other drilling operations.

The bottom hole assembly of any preceding clause, wherein the threshold is based on captured data from another bottom hole assembly that includes at least one sensor configured to directly measure high frequency torsional oscillation along with other instances of the plurality of sensors to correlate an amplitude of difference to the threshold based at least in part on the direct high frequency torsional oscillation measurements.

The bottom hole assembly of any preceding clause, wherein the empirical data is based at least in part on laboratory testing of other drilling tools and comparing logs of the common measurement type to testing of whether the other drilling tools have been subjected to high frequency torsional oscillations.

The bottom hole assembly of any preceding clause, wherein the threshold is dynamically based at least in part on an age of the plurality of drilling tools.

The bottom hole assembly of any preceding clause, wherein the age includes time since manufacture for the plurality of drilling tools, a drilling time overall for the plurality of drilling tools, a current drilling time in a continuous drilling operation for the plurality of drilling tools, or a combination thereof.

The bottom hole assembly of any preceding clause, wherein comparing the difference to the threshold includes determining that a duration for the difference exceeding the threshold is less than a duration threshold indicating that the difference is transient and correlates to a high frequency torsional oscillation occurrence.

The bottom hole assembly of any preceding clause, wherein the plurality of sensors are configured to monitor the common measurement type at a first frequency, high frequency torsional oscillation in the plurality of drilling tools is directly detectable at a second frequency, and the second frequency is one order of magnitude higher than the first frequency.

Non-transitory, computer-readable media having stored thereon instructions, that when executed by one or more processors, are configured to cause the one or more processors to control a drilling operation of a drill string that includes a plurality of sensors to capture a measurement type at a plurality of locations along the drill string, receive an indication that high frequency torsional oscillation has likely occurred based at least in part on the capture of the measurement type at the plurality of locations, and take an appropriate action in response to the indication that high frequency torsional oscillation has likely occurred.

Non-transitory, computer-readable media of any preceding clause, wherein the plurality of sensors are configured to monitor the measurement type at a first frequency, high frequency torsional oscillation in the drill string is directly detectable at a second frequency, and the second frequency is one order of magnitude higher than the first frequency.

Non-transitory, computer-readable media of any preceding clause, wherein the appropriate action includes raising an alert on a display, in a cloud network, or a combination thereof.

Non-transitory, computer-readable media of any preceding clause, wherein the appropriate action includes changing a speed in the drilling operation or a weight on bit in the drilling operation.

Non-transitory, computer-readable media of any preceding clause, wherein the measurement type includes a tool face orientation in the drill string at the plurality of locations, an angular velocity at the plurality of locations, or a combination thereof.

A method includes capturing, using a plurality of sensors, a plurality of instances of a measurement type at a plurality of locations along a drill string in a wellbore. The method also includes comparing, using processing circuitry, the plurality of instances of the measurement type to determine a variation between the plurality of instances of the measurement type and determining, using the processing circuitry, that the variation is greater than a threshold corresponding to high frequency torsional oscillation. The method further includes sending, using the processing circuitry, an indication that high frequency torsional oscillation has likely occurred based at least in part on the comparison of the plurality of instances of the measurement type and the threshold. Furthermore, the method includes changing, using a processor, a parameter of a drilling operation in the wellbore based at least in part on receiving the indication that high frequency torsional oscillation has likely occurred.

The method of any preceding clause, wherein the measurement type includes tool face orientations at the plurality of locations, angular velocity at the plurality of locations, or a combination thereof, and wherein the plurality of sensors are configured to monitor the measurement type at a first frequency, high frequency torsional oscillation in the drill string is directly detectable at a second frequency, and the second frequency is one order of magnitude higher than the first frequency.

The method of any preceding clause, comprising updating the threshold based on change in formation type being drilled, based on change in age of the drill string, based on change in wellbore trajectory, based on accumulated field test results, based on machine learning updates, or a combination thereof.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

In the claims, means-plus-function clauses are intended to cover the structures described herein as performing the recited function and not only structural equivalents, but also equivalent structures. Thus, for example, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A bottom hole assembly for a wellbore, comprising:

a drill bit;

a plurality of drilling tools comprising:

a first sensor configured to capture a first instantaneous measurement of a measurement type at a first location along a drill string, wherein the first sensor has a first measurement frequency; and a second sensor configured to capture a second instantaneous measurement of the measurement type at a second location along the drill string, wherein the second sensor has a second measurement frequency; and processing circuitry configured to:

compare the first instantaneous measurement and the second instantaneous measurement to determine a difference between the first instantaneous measurement and the second instantaneous measurement;

determine that the difference is greater than a threshold corresponding to an inference of high frequency torsional oscillation having a high frequency torsional oscillation frequency, wherein the first measurement frequency and the second measurement frequency are less than the high frequency torsional oscillation frequency by at least one order of magnitude;

send an indication of an occurrence of high frequency torsional oscillation in the bottom hole assembly; and cause a change in a rotational rate of the drill bit using the indication of the occurrence of high frequency torsional oscillation.

2. The bottom hole assembly of claim 1, wherein the plurality of drilling tools comprises:

a logging while drilling tool, the logging while drilling tool comprising the first sensor or the second sensor; or a rotary-steerable system, the rotary-steerable system comprising the first sensor or the second sensor.

3. The bottom hole assembly of claim 1, wherein the measurement type comprises a tool face orientation for at least one drilling tool of the plurality of drilling tools.

4. The bottom hole assembly of claim 1, wherein the measurement type comprises angular velocities at the plurality of locations.

5. The bottom hole assembly of claim 1, wherein the threshold is based at least in part on simulations of drilling operations in various drilling environments.

6. The bottom hole assembly of claim 1, wherein the threshold is based at least in part on empirical data from other drilling operations.

7. The bottom hole assembly of claim 6, wherein the threshold is based on captured data from another bottom hole assembly that includes at least one sensor configured to directly measure high frequency torsional oscillation and also includes an additional plurality of sensors to capture the measurement type to correlate an amplitude of difference for the measurement type to the threshold based at least in part on the direct high frequency torsional oscillation measurements.

8. The bottom hole assembly of claim 6, wherein the empirical data is based at least in part on laboratory testing of other drilling tools and comparing logs of the measurement type to testing of whether the other drilling tools have been subjected to high frequency torsional oscillations.

9. The bottom hole assembly of claim 1, wherein the threshold is dynamically based at least in part on an age of the plurality of drilling tools.

10. The bottom hole assembly of claim 9, wherein the age comprises time since manufacture for the plurality of drilling tools, a drilling time overall for the plurality of drilling tools, a current drilling time in a continuous drilling operation for the plurality of drilling tools, or a combination thereof.

11. The bottom hole assembly of claim 1, wherein comparing the difference to the threshold comprises determining that a duration for the difference exceeding the threshold is less than a duration threshold indicating that the difference is transient and correlates to a high frequency torsional oscillation occurrence.

12. The bottom hole assembly of claim 1, wherein the processing circuitry is further configured to cause a change in a weight on bit of the bit.

13. The bottom hole assembly of claim 1, wherein the first instantaneous measurement and the second instantaneous measurement are at the same time.

14. A method, comprising:

capturing, using a first sensor and with a first measurement frequency, a measurement type at a first location along a drill string in a wellbore;

capturing, using a second sensor and with a second measurement frequency, the measurement type at a second location along the drill string in the wellbore;

comparing, using processing circuitry, a first instance of the measurement type from the first sensor and a second instance of the measurement type from the second sensor, the first instance and the second instance being at the same time, to determine a variation between the first instance and the second instance of the measurement type;

determining, using the processing circuitry, that the variation is greater than a threshold corresponding to high frequency torsional oscillation, wherein the high frequency torsional oscillation has a high frequency torsional oscillation frequency that is at least one order of magnitude larger than the first measurement frequency and the second measurement frequency;

sending, using the processing circuitry, an indication that high frequency torsional oscillation has occurred based at least in part on the comparison of the first instance and the second instance of the measurement type and the threshold; and changing, using a processor, a weight on bit and a rotational rate of the drill string using the indication that high frequency torsional oscillation has likely occurred.

15. The method of claim 14, wherein the measurement type comprises:

tool face orientations, angular velocity, or a combination thereof.

16. The method of claim 14, further comprising updating the threshold based on change in formation type being drilled, based on change in age of the drill string, based on change in wellbore trajectory, based on accumulated field test results, based on machine learning updates, or a combination thereof.

* * * * *